US008939814B2

(12) United States Patent
Kweon et al.

(10) Patent No.: US 8,939,814 B2
(45) Date of Patent: Jan. 27, 2015

(54) SMART TOY DRIVING SYSTEM FOR MOBILE TERMINAL

(71) Applicant: Hysonic. Co., Ltd, Ansan-si (KR)

(72) Inventors: Gi Tae Kweon, Ansan-si (KR); Hyun Wook Lee, Ansan-si (KR); Hye Kyoung Ji, Ansan-si (KR); He Won Jung, Ansan-si (KR)

(73) Assignee: Hysonic. Co., Ltd. (KR)

( * ) Notice: Subject to any disclaimer, the term of this patent is extended or adjusted under 35 U.S.C. 154(b) by 23 days.

(21) Appl. No.: 13/873,560

(22) Filed: Apr. 30, 2013

(65) Prior Publication Data

US 2014/0134918 A1 May 15, 2014

(30) Foreign Application Priority Data

Nov. 14, 2012 (KR) ..... 10-2012-0128489

(51) Int. Cl.
*A63H 29/22* (2006.01)
*A63H 5/00* (2006.01)

(52) U.S. Cl.
CPC ..... *A63H 5/00* (2013.01); *A63H 2200/00* (2013.01)
USPC ..... 446/484

(58) Field of Classification Search
USPC ..... 446/484
See application file for complete search history.

(56) References Cited

U.S. PATENT DOCUMENTS 4,658,928 A * 4/1987 Seo ..... 180/168
6,157,966 A * 12/2000 Montgomery et al. ..... 710/8
6,227,931 B1 * 5/2001 Shackelford ..... 446/268
6,320,597 B1 * 11/2001 Ieperen ..... 345/629
6,326,954 B1 * 12/2001 Van Ieperen ..... 345/173
6,348,257 B1 * 2/2002 Koike et al. ..... 428/206
6,349,257 B1 * 2/2002 Liu et al. ..... 701/438
6,443,796 B1 * 9/2002 Shackelford ..... 446/91
6,719,605 B2 * 4/2004 Ichikawa ..... 446/330
6,741,267 B1 * 5/2004 Leperen ..... 715/773

(Continued)

FOREIGN PATENT DOCUMENTS

KR 100725825 5/2007
KR 2020110010865 11/2011
KR 101163052 6/2012

OTHER PUBLICATIONS

Meisa Kuroki, "Smart pet using the iPhone, which is manufactured by Bandai Corp.", Mac Treasure appraisal organization Blog [Compass], Mar. 26, 2012.

*Primary Examiner* — Michael Dennis
*Assistant Examiner* — Dolores Collins
(74) *Attorney, Agent, or Firm* — Cantor Colburn LLP

(57) ABSTRACT

A smart toy driving system for a mobile terminal connected to the mobile terminal such that a reaction generated by an interaction between a certain character and a mobile terminal user upon the execution of an application installed in the mobile terminal is expressed in a motion of the character. The smart toy driving system includes a mobile terminal provided with an audio signal generating part which generates an audio signal having a predetermined pattern and then outputs it through a terminal part for outputting a sound; and a character which is detachably coupled to the terminal part of the mobile terminal so as to receive the audio signal, wherein the character comprises a signal converting part which converts the received audio signal into a driving signal preset according to a predetermined patterned waveform, and a mechanism part which takes a predetermined mechanical action according to the converted driving signal.

5 Claims, 11 Drawing Sheets

(56) References Cited

U.S. PATENT DOCUMENTS

| | | | | |
|---|---|---|---|---|
| 6,949,003 | B2 * | 9/2005 | Hornsby et al. | 446/484 |
| 7,127,529 | B2 * | 10/2006 | Montgomery et al. | 710/1 |
| 7,151,533 | B2 * | 12/2006 | Van Ieperen | 345/173 |
| 7,401,320 | B2 * | 7/2008 | Brunet et al. | 717/101 |
| 7,491,108 | B2 * | 2/2009 | Ghaly | 446/175 |
| 7,757,001 | B2 * | 7/2010 | van Ieperen | 709/246 |
| 8,195,236 | B2 * | 6/2012 | Itay et al. | 455/558 |
| 8,261,972 | B2 * | 9/2012 | Ziegler | 235/375 |
| 8,352,643 | B2 * | 1/2013 | Birnbaum et al. | 710/16 |
| 8,472,866 | B1 * | 6/2013 | Spector | 455/3.06 |
| 8,506,343 | B2 * | 8/2013 | Goff et al. | 446/175 |
| 8,591,281 | B2 * | 11/2013 | Mimlitch et al. | 446/3 |
| 8,660,891 | B2 * | 2/2014 | Ramer et al. | 705/14.1 |
| 8,700,009 | B2 * | 4/2014 | Quy | 455/414.1 |
| 8,725,065 | B2 * | 5/2014 | Spector | 455/3.06 |
| 8,738,080 | B2 * | 5/2014 | Nhiayi | 455/557 |
| 8,761,748 | B2 * | 6/2014 | Lee et al. | 455/418 |
| 2001/0000814 | A1 * | 5/2001 | Montgomery et al. | 710/10 |
| 2005/0277102 | A1 * | 12/2005 | Gillette et al. | 434/350 |
| 2008/0076474 | A1 * | 3/2008 | Ho | 455/558 |
| 2010/0010669 | A1 * | 1/2010 | Lee et al. | 700/245 |
| 2012/0158897 | A1 * | 6/2012 | Sundaram | 709/217 |
| 2013/0040530 | A1 * | 2/2013 | Matsuno | 446/73 |
| 2013/0059284 | A1 * | 3/2013 | Giedgowd et al. | 434/365 |
| 2013/0222668 | A1 * | 8/2013 | Anderson | 348/333.08 |
| 2013/0252669 | A1 * | 9/2013 | Nhiayi | 455/557 |
| 2013/0252670 | A1 * | 9/2013 | Spector | 455/557 |
| 2013/0288563 | A1 * | 10/2013 | Zheng et al. | 446/268 |
| 2013/0318784 | A1 * | 12/2013 | Elliott | 29/805 |
| 2014/0038489 | A1 * | 2/2014 | Sharma et al. | 446/175 |
| 2014/0110470 | A1 * | 4/2014 | Segal | 235/375 |

* cited by examiner (a)

(b)

SMART TOY DRIVING SYSTEM FOR MOBILE TERMINAL

TECHNICAL FIELD

The present invention relates to a smart toy driving system for a mobile terminal, and more particularly, to a smart toy driving system for a mobile terminal, which is connected to the mobile terminal such that a reaction generated by an interaction between a certain character and a mobile terminal user upon the execution of an application installed in the mobile terminal is expressed in a motion of the character.

BACKGROUND ART

Recently, as mobile terminals and wireless communication technologies are developed, many people use the mobile terminals, and use time of the mobile terminal is gradually increased.

Meanwhile, besides the main functions like wireless communication of the mobile terminal, an entertainment function which is free of space and time is also used widely.

Especially, this entertainment function is used by downloading and installing various applications including a plurality of game applications from a download server communicated with the mobile terminal In Korean Patent No. 10-0725825, there is disclosed a character raising game method and system using a mobile terminal.

FIG. 1 shows a conventional system which can download a character raising game to a mobile terminal The character raising game using the mobile terminal includes a step of generating a desired capsule, after growth of a character is completed, in the mobile terminal; a step of inputting a message and a receiver number and then transmitting the message together with the capsule; a step of verifying the receiver number in a server and then checking whether the receiver has an application for the character raising game; a step in which the receiver raises the character generated from the capsule; and a step of outputting the transferred message after growth of the character is completed.

And as shown in FIG. 1, the character raising game using the mobile terminal includes a content provider which obtains approval of a telecommunication company and provides a character raising game content; a download server in which the character raising game content provided from the content provider is registered and transmitted on the basis of download request; and a mobile terminal which requests to download the character raising game content, downloads the character raising game content from the download server through wireless Internet and then executes the character raising game content.

The character raising game can be executed in the state that raising elements (feeding, washing, curing or the like) for raising the character are mini-gamified.

However, in the conventional character game which uses only video information displayed through a display part of the mobile terminal, there is limitation in providing interest and entertainment value in the game.

Meanwhile, in Korean Patent No. 10-1163052, there is disclosed an accessory of a mobile terminal.

FIG. 2 is a perspective view of an accessory of a conventional mobile terminal.

The accessory of the conventional mobile terminal includes a housing 200 formed with an internal space in which a wire of an earphone is wound/received and then released/expanded when being used; a depression tip 100 which is detachable coupled to one side of the housing 200 so as to be inserted into an earphone jack 510 of the mobile terminal, and presses a touch-screen type display panel 520 in order to input a command; and at least one or more LED 300 which is installed at the housing 200 and electrically connected to the mobile terminal 500 so as to emit light when the mobile terminal receives a call. When using the earphone 400, the pressing tip 100 is separated from the housing 200, and a separate earphone connecting terminal 410 is coupled to the housing 200.

Herein, the housing 200 may be formed into a certain-shaped character in order to induce a customer to buy it.

The accessory of the conventional mobile terminal is inserted into the earphone jack 510 of the mobile terminal so as to emit light of the LED 300. However, the accessory does not have any other functions for inducing a customer to buy it, except that it just has the certain-shaped character or emits the LED 300.

SUMMARY OF THE INVENTION

An object of the present invention is to provide a smart toy driving system for a mobile terminal, which is connected to the mobile terminal such that a reaction generated by an interaction between a certain character and a mobile terminal user upon the execution of an application installed in the mobile terminal is expressed in a motion of the character.

To achieve the object of the present invention, the present invention can provide a smart toy driving system for a mobile terminal, including a mobile terminal provided with an audio signal generating part which generates an audio signal having a predetermined pattern and then outputs it through a terminal part for outputting a sound; and a character which is detachably coupled to the terminal part of the mobile terminal so as to receive the audio signal, wherein the character comprises a signal converting part which converts the received audio signal into a driving signal preset according to a predetermined patterned waveform, and a mechanism part which takes a predetermined mechanical action according to the converted driving signal.

Preferably, the smart toy driving further includes a display part which displays a character image interlocked with the character coupled to the terminal part.

Preferably, the mechanism part further comprises a fixing part which is coupled to the terminal part, a first operating part which is coupled to the fixing part so as to take a predetermined action according to a first audio signal, and a second operating part which is coupled to the fixing part so as to take a predetermined action according to a second audio signal and which is independently operated from the first operating part, and the first and second audio signals form a two-channel stereo signal.

Preferably, the mechanism part further comprises a driving part which is driven the two-channel stereo signal formed by the first and second audio signals.

Preferably, the driving part comprises a magnet which generates a magnetic field; and a coil which is installed at an end of each of the first and second operating parts and which receives the driving signal and generates driving force for rotating the first and second operating parts caused by an electromagnetic interaction with the magnetic field generated from the magnet.

Preferably, the signal converting part comprises a rectifying circuit which converts an audio signal having an AC waveform into an audio signal having a DC waveform.

Preferably, the rectifying circuit is a bridge rectifying circuit.

According to the smart toy driving system for the mobile terminal of the present invention, since it is connected to the mobile terminal such that the reaction generated by the interaction between the certain character and the mobile terminal user upon the execution of an application installed in the mobile terminal is expressed in a motion of the character, it is possible to characterfully express the mobile terminal, double an interest in it and also provide more realistic game.

BRIEF DESCRIPTION OF THE DRAWINGS

The above and other objects, features and advantages of the present invention will become apparent from the following description of preferred embodiments given in conjunction with the accompanying drawings, in which.

DETAILED DESCRIPTION OF THE INVENTION

Hereinafter, the embodiments of the present invention will be described in detail with reference to accompanying drawings.

Figure 1:
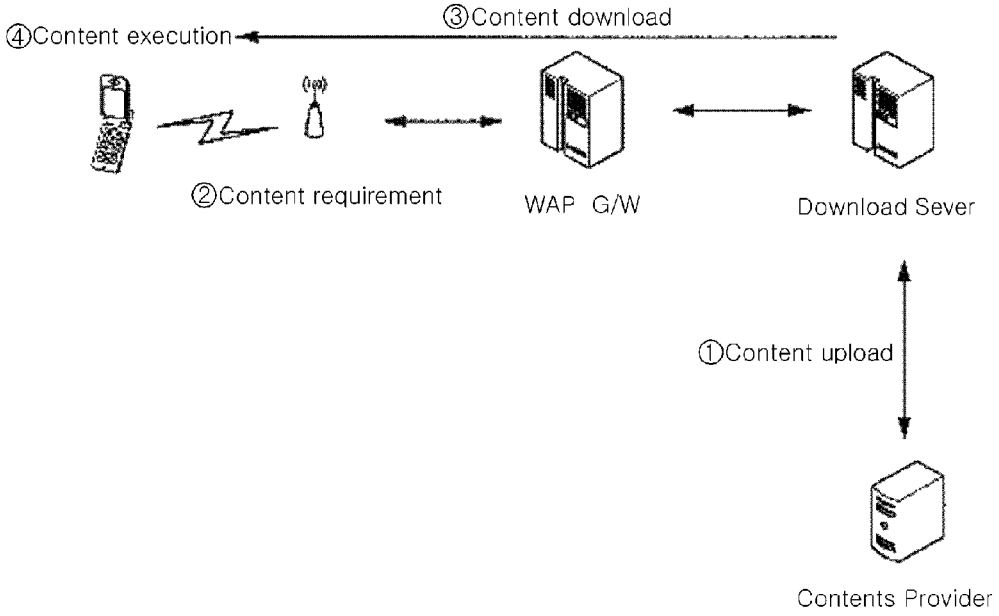
Figure 1 Prior Art
FIG. 1 shows a conventional system which can download a character raising game to a mobile terminal
Figure 2:
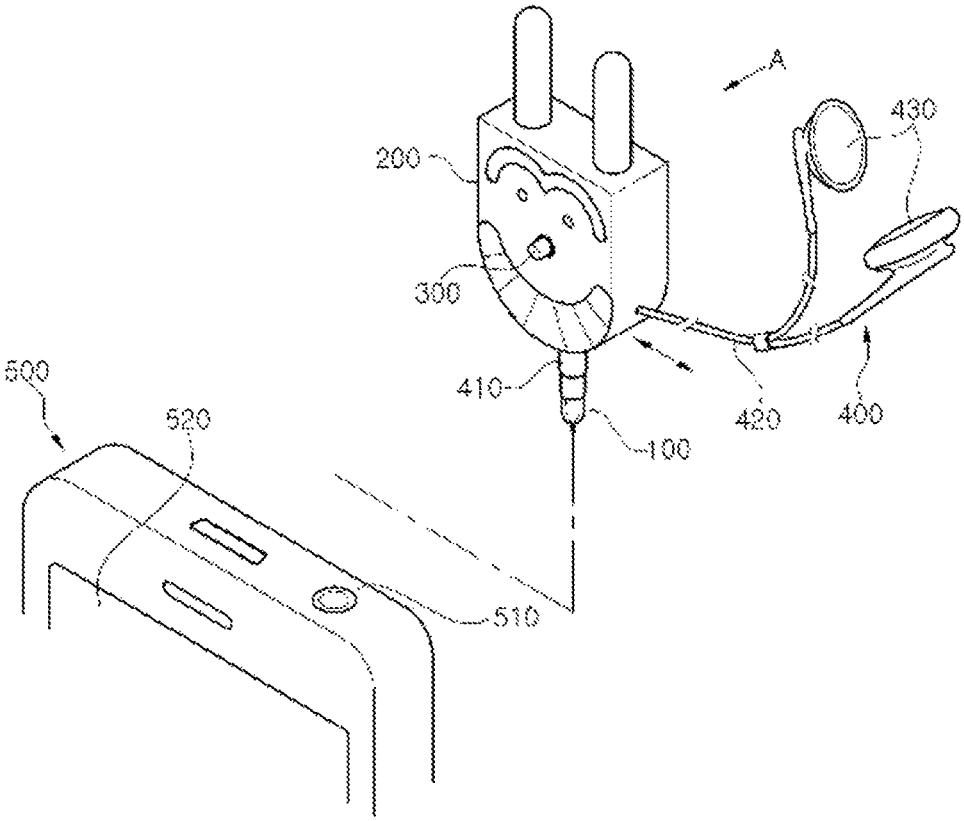
Figure 2 Prior Art
FIG. 2 is a perspective view of an accessory of a conventional mobile terminal.
Figure 3:
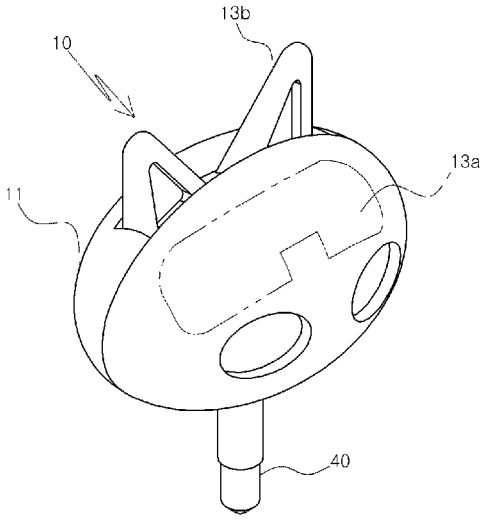
FIG. 3 is a perspective view of a smart toy driving system for a mobile terminal according to an embodiment of the present invention.
Figure 3:
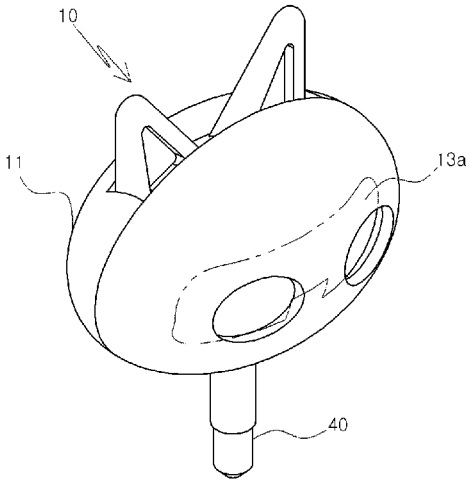
Figure 4:
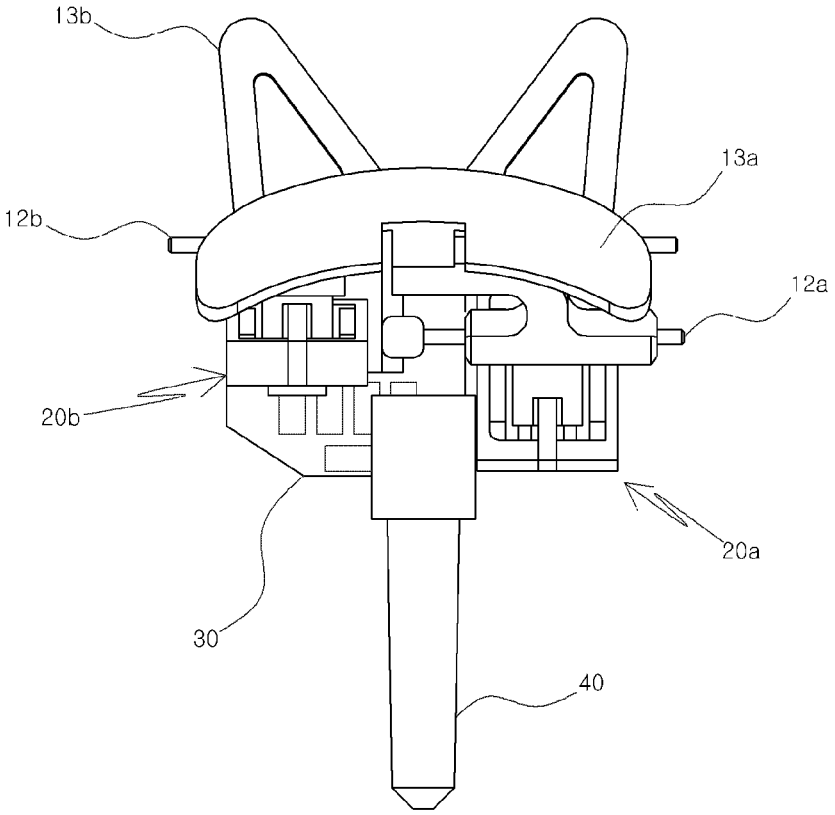
FIG. 4 is a front view of the smart toy driving system for the mobile terminal, which is exclusive of a fixing part.

FIG. 3 is a perspective view of a smart toy driving system for a mobile terminal according to an embodiment of the present invention, FIG. 4 is a front view of the smart toy driving system for the mobile terminal, which is exclusive of a fixing part.

Figure 5:
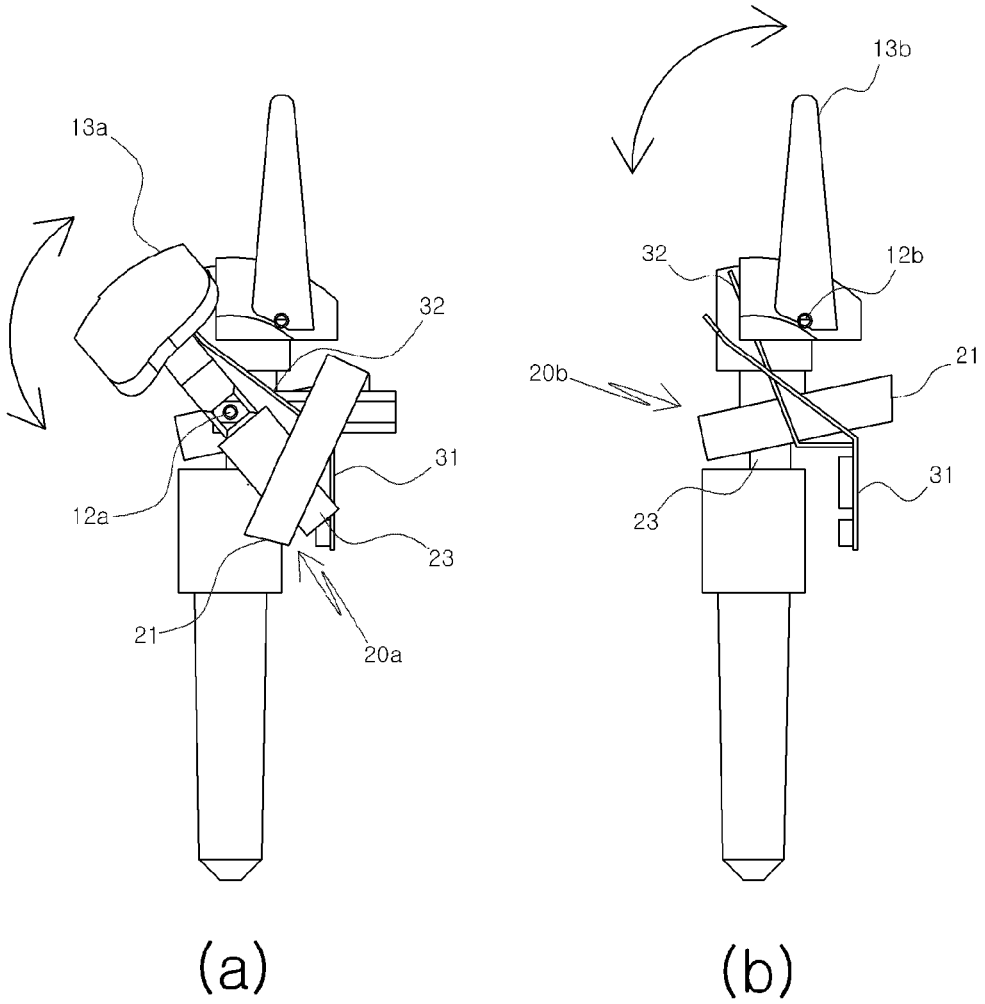
FIG. 5 is a right side view of FIG. 4.
Figure 6:
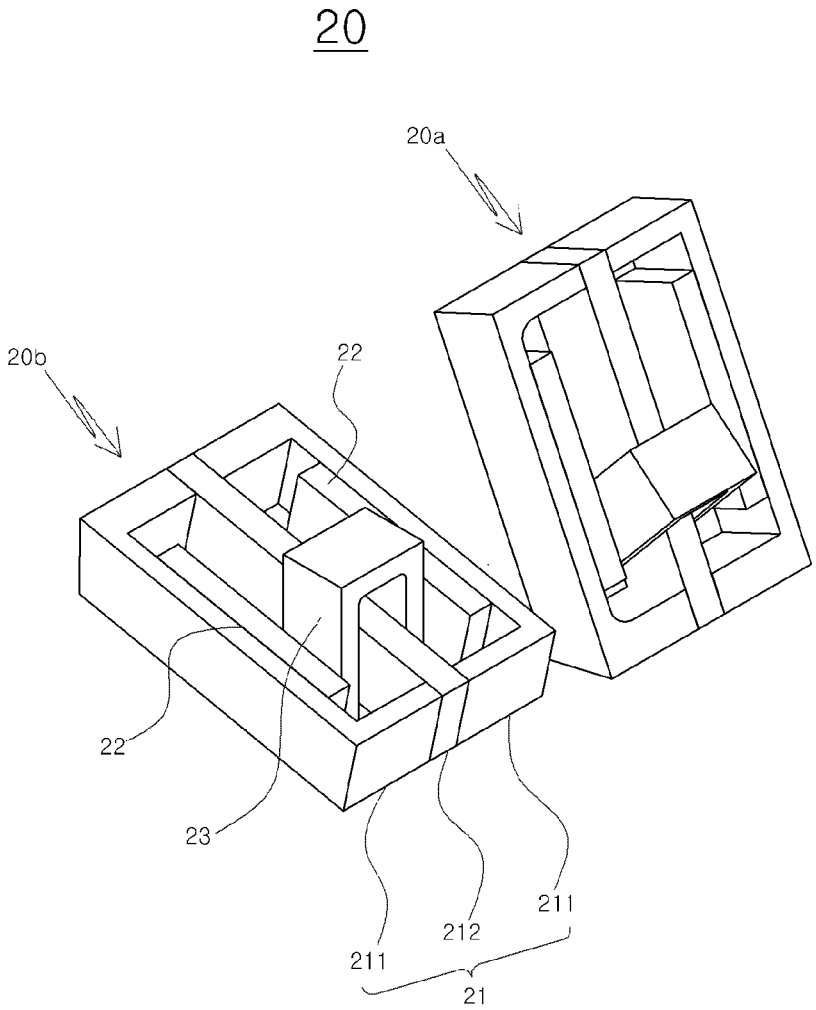
FIG. 6 is a view of a driving part according to the embodiment of the present invention.
Figure 7:
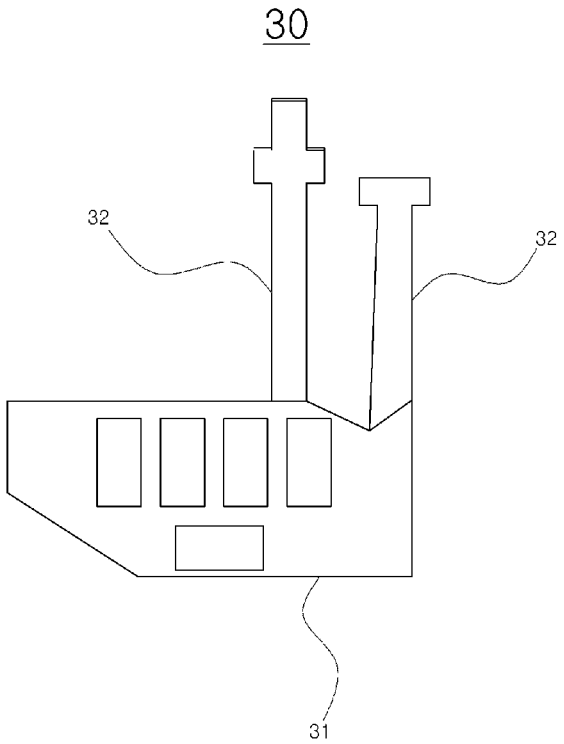
FIG. 7 is a view of a circuit part according to the embodiment of the present invention.
Figure 8:
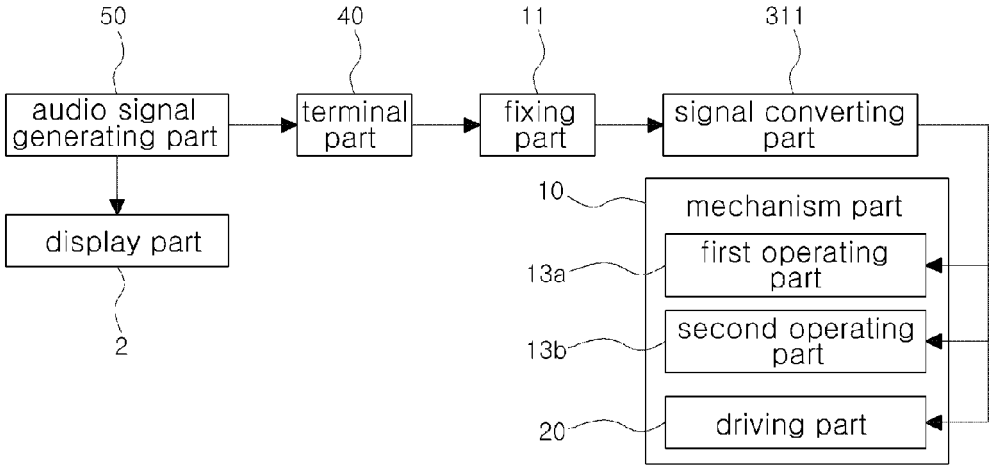
FIG. 8 is a block diagram of a driving system in the smart toy driving system for the mobile terminal according to the embodiment of the present invention.
Figure 9:
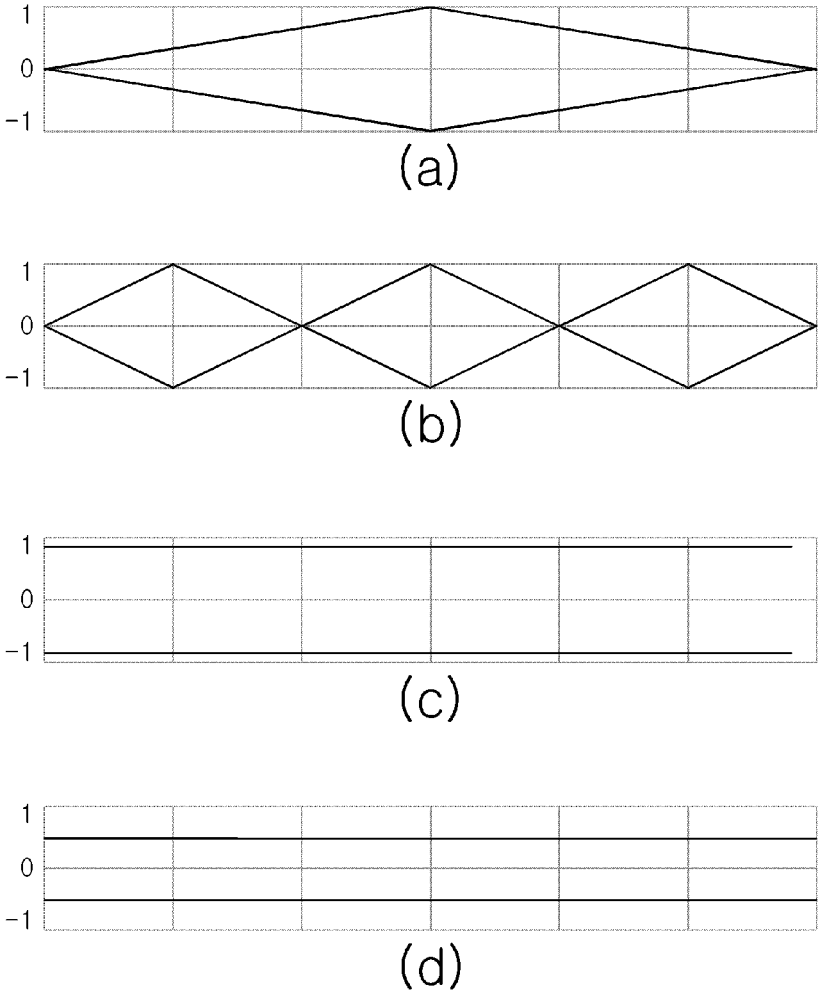
FIG. 9 is a view of a waveform of an audio signal output from an audio signal generating part according to the embodiment of the present invention.
Figure 10:
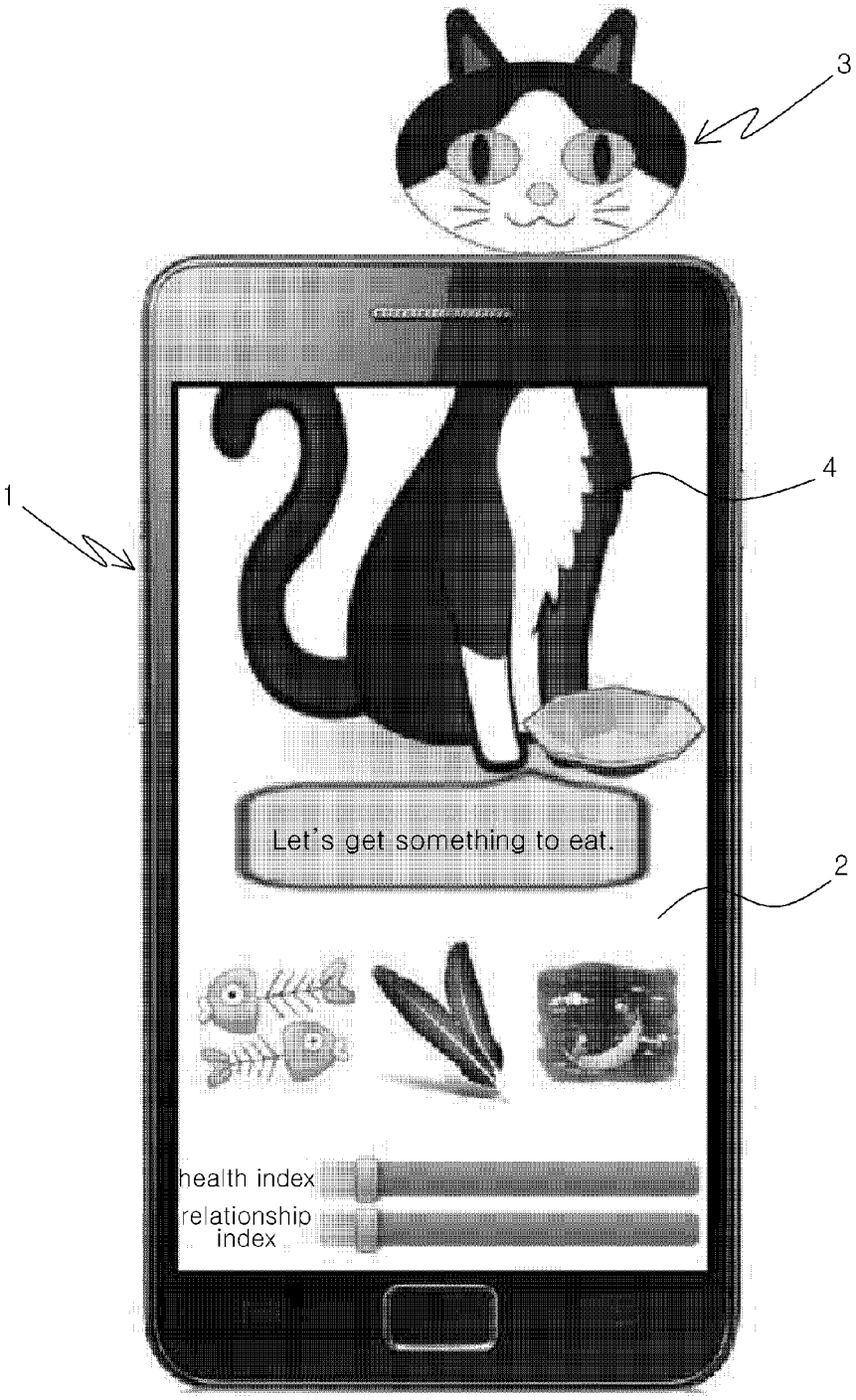
FIG. 10 is a view showing the state that a motion character is coupled to the mobile terminal.
Figure 11:
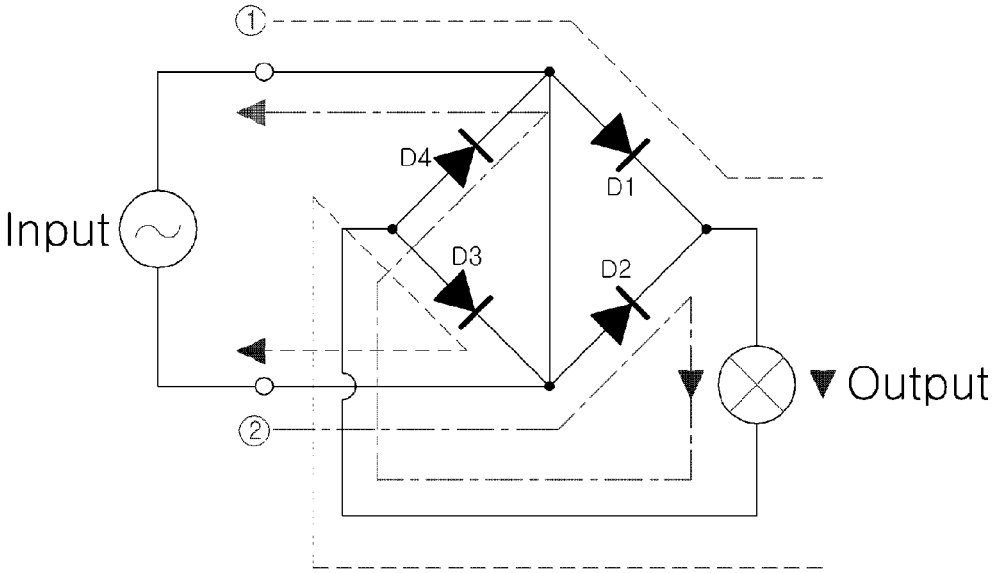
FIG. 11 is a view of a rectifying circuit of a signal converting part according to the embodiment of the present invention.

FIG. 5 is a right side view of FIG. 4, FIG. 6 is a view of a driving part according to the embodiment of the present invention, FIG. 7 is a view of a circuit part according to the embodiment of the present invention, FIG. 8 is a block diagram of a driving system in the smart toy driving system for the mobile terminal according to the embodiment of the present invention, FIG. 9 is a view of a waveform of an audio signal output from an audio signal generating part according to the embodiment of the present invention, FIG. 10 is a view showing the state that a motion character is coupled to the mobile terminal, and FIG. 11 is a view of a rectifying circuit of a signal converting part according to the embodiment of the present invention.

A smart toy driving system for a mobile terminal according to an embodiment of the present invention may include a mobile terminal 1 and a character 3. Herein, it is preferable that the mobile terminal 1 is a smart phone or a tablet PC. The character 3 may be formed into various shapes, e.g., an animal head shape, which can be detachable installed at the mobile terminal 1.

More detailedly, the mobile terminal 1 includes an audio signal generating part 50, a terminal part 40 and a display part 2.

Herein, the audio signal generating part 50 generates an audio signal having a desired patterned waveform or a user's voice signal which is previously stored in a memory. The audio signal may be output through the terminal part 40.

The terminal part 40 is an audio output terminal for outputting the audio signal, which is detachably coupled to an earphone.

The display part 2 may be a touch screen which can display a character image 4.

And the character 3 may include a fixing part 11, a signal converting part 311 and a mechanism part 10. The mechanism part 10 includes a first operating part 13*a*, a second operating part 13*b* and a driving part 20.

The character 3 is detachably coupled to the terminal part 40 of the mobile terminal 1 through the fixing part 11. The fixing part 11 is the whole body of the character 3 which may be formed into various shapes.

The signal converting part 311 functions to convert the audio signal received from the audio signal generating part 50 into a desired driving signal having a predetermined patterned waveform.

The driving signal adapts the mechanism part 10 to take a predetermined action.

A driving shaft 12*a*, 12*b* is fixed to the fixing part 11 and functions as a rotational shaft of the operating part 13*a*, 13*b*. The driving shaft consists of a first driving shaft 12*a* and a second driving shaft 12*b*.

The operating part 13*a*, 13*b* is coupled to the driving shaft 12*a*, 12*b* so as to be rotated around the driving shaft 12*a*, 12*b*. Detailedly, as shown in FIG. 5, the operating part 13*a*, 13*b* consists of the first operating part 13*a* which is rotated around the first driving shaft 12*a* and the second operation part 13*b* which is rotated around the second driving shaft 12*b*.

More detailedly, in the embodiment, the fixing part 11 is formed into a shape of an animal face, and the first operating part 13*a* functions as an eyelid of the animal shape so that the character 3 blinks when the first operating part 13*a* is rotated around the first driving shaft 12*a*, and the second operating part 13*b* functions as an ear of the animal shape so that the ear is moved when the second operating part 13*b* is rotated around the second driving shaft 12*b*.

The first and second operating parts 13*a* and 13*b* can express motions of various portions besides the eyelid and ear of the animal shape. Otherwise, one driving shaft and operating part may be provide so as to move only one of the eyelid and ear of the animal shape.

Further, the fixing part 11 is not limited to the animal face and may be formed into various shapes.

Meanwhile, FIGS. 9*a* and 9*b* show a triangular waveform of the audio signal generated from the audio signal generating part 50.

Further, FIGS. 9*c* and 9*d* show one of various waveforms of the audio signal generated from the audio signal generating part 50 so as to maintain constant voltage.

FIG. 9 is one of examples showing a certain pattern out of the various waveforms of the audio signal, as described above, wherein the mechanism part 10 can take various actions according to the audio signals having various waveforms.

The audio signal may be various sound source files (wav.mp3) having certain patterns, which are stored in the audio signal generating part 50 and output to the outside through an audio output terminal of the mobile terminal 1.

That is, the audio signal is generally the sound source file output through the audio output terminal of the mobile terminal 1 to which an earphone is coupled, in order to output a sound wave having a certain pattern.

Detailedly, the audio signal is a two-channel stereo signal and comprised of a first audio signal and a second audio signal. The first and second audio signals are respectively transmitted to the first and second driving parts 20*a* and 20*b* in the same manner that the audio signal is output to both sides of an earphone connected to the mobile terminal, such that each sound can be transmitted to both ears of a user.

The first and second audio signals are transmitted to the signal converting part 311 through the terminal part 40 and then converted into driving signals (DC) for driving the mechanism part 10 by the rectifying circuit of the signal converting part 311.

In other words, the first operating part 13*a* is operated by the first audio signal, and the second operating part 13*b* is operated by the second audio signal.

And if the audio signal is not generated, the first and second operating parts are not operated.

That is, as shown in FIG. 10, if the audio signal is not generated, the eyes of the character are maintained in the state of being opened, and the ears thereof are maintained in the state of remaining stationary.

If the audio signal has the triangular waveform, the eyes of the character are closed and then opened by the first operating part 13*a*, and the ears thereof are folded forward and then erected again.

The first and second operating parts 13*a* and 13*b* may be simultaneously or independently operated by the waveform of the audio signal.

As shown in FIGS. 9*a* and 9*b*, as a period of the triangular waveform is shortened, the first and second operating parts 13*a* and 13*b* are operated more quickly, and thus the eyes and ears of the character are also moved rapidly.

Further, as shown in FIG. 9*c*, if the audio signal is held in constant voltage, the first and second operating parts 13*a* and 13*b* are maintained in the state of being rotated from an initial position, such that the eyes of the character are held in the state of being closed and the ears thereof are held in the state of being folded.

As shown in FIG. 9*d*, if the voltage of the audio signal is generated to be lower than that of the state that the eyes of the character are closed or the ears thereof are folded, the eyes of the character may be held in the state of being half closed and the ears thereof may be held in the state of being half folded.

As described above, the motion of the character can be expressed variously according to the waveforms and properties of the audio signal.

Meanwhile, in other embodiment, if only a single operating part 13*a*, 13*b* is provided, the first and second audio signals operates one driving part 20 at the same time.

As described above, the first and second audio signals operates the first and second driving parts 20*a* and 20*b* so as to drive the first and second operating parts 13*a* and 13*b*. However, if one driving part 20 is operated by simultaneously using the first and second audio signals, driving force of the driving part 20 is more increased, and thus the single operating part can take a larger action.

Detailedly, when the first and second operating parts 13*a* and 13*b* are operated, a stereo audio signal consisting of the first and second audio signals operates the first and second driving parts 20*a* and 20*b* together with each ground signal. When one driving part is operated, the single driving part 20 is operated by using the first and second audio signals without the ground signal.

Therefore, one driving part operated by the first and second audio signals can obtain the driving force of two times.

The terminal part 40 is coupled to the mechanism part 10 and connected with the audio output terminal of the mobile phone 1 so as to transmit the audio signal generated from the audio signal generating part 50 to the signal converting part 311.

That is, the terminal part 40 is inserted into the audio output terminal of the mobile terminal 1, in which an earphone is inserted, in order to transmit the audio signal to the signal converting part 311.

The signal converting part 311 is provided in the mechanism part 10 so as to receive the audio signal from the terminal part 40 and then convert it to a driving signal.

The signal converting part 311 is a rectifying circuit for converting an audio signal (AC signal) having an AC waveform into a driving signal (DC signal) having a DC waveform, in which four diodes D1, D2, D3 and D4 are connected in the formed of a bridge in order to perform the rectifying, as shown in FIG. 11.

A current out of the AC signal input from the terminal part 40 to the signal converting part 311, which is input to ① of the bridge rectifying circuit, is flowed along the diode D1, D3 having directional property, and a current which is input to ② is flowed along the diode D2, D4 having directional property. Therefore, all of the currents input to ① and ② are output in the same direction, and then converted into the DC signal.

The converted driving signal having the DC waveform is transmitted to the driving part 20. The bridge rectifying circuit is a kind of full wave rectifying circuit which can efficiently rectify an AC voltage.

As described above, the bridge rectifying circuit is an example of the rectifying circuit as the signal converting part 311. If necessary, various other rectifying circuits may be applied instead of the bridge rectifying circuit.

Detailedly, the signal converting part 311 is mounted on a circuit part 30 formed into a circuit board so as to receive the audio signal, convert the audio signal into the driving signal for controlling the action of the mechanism part 10 according to the waveform of the audio signal and then transmit the driving signal to the driving part 20.

In other words, the circuit part 30 receives the audio signal as a control signal from the terminal part 40, converts the audio signal into the driving signal in the signal converting part 311 and then operates the driving part 20.

The circuit part 30 is formed into the circuit board formed of an elastic material, and the circuit board is connected to the operating part 13*a*, 13*b* so as to provide restoring force to the operating part 13*a*, 13*b* when the operating part 13*a*, 13*b* is operated.

Detailedly, as shown in FIG. 7, the circuit part 30 includes a mounting part 31 and an elastic part 32.

A control circuit and the signal converting part 311 are mounted on the mounting part 311.

One end of the elastic part 32 is extended from the mounting part 31, and the other end thereof is connected to each of the operating parts 13*a* and 13*b*.

As shown in FIG. 5, the other end of the elastic part 32 is connected to an end of the operating part 13*a*, 13*b* so as to be opposed to the driving part 20 with the driving shaft 12*a*, 12*b* as the center.

Therefore, when the operating part 13*a*, 13*b* is operated by the driving part 20, the elastic part 32 is elastically deformed together. And when the operating part 13*a*, 13*b* is stopped, the elastic part 32 provides the restoring force to the operating part 13*a*, 13*b* so that the operating part 13*a*, 13*b* is returned to its original position.

The driving part 20 includes the first driving part 20*a* and the second driving part 20*b*, and the circuit part 30 independently operates the first and second driving parts 20*a* and 20*b*.

The driving part 20 is operated by the circuit part 30 so as to provide driving force so that the mechanism part takes a certain action.

Detailedly, as shown in FIG. 6, the driving part 20 consists of a yoke 21, a magnet 22 and a coil 23.

The yoke 21 is fixedly installed in the fixing part 11 and the magnet 22 is installed therein.

More detailedly, in the yoke 21, two main yokes 211 formed into "[" shape are disposed so that opened portions thereof are faced with each other, and a linear sub-yoke 212 is disposed therebetween.

The magnet 22 generates a magnetic field so that the magnetic field is formed around the coil 23.

The magnet 22 is fixed to an inner side of each of the two main yoke 211 so as to be spaced apart from each other.

The coil 23 is installed at an end of the operating part 13*a*, 13*b*. When the control signal is received from the circuit part 30, the coil 23 generates the driving force for rotating the operating part 13*a*, 13*b* caused by an electromagnetic interaction with the magnetic field generated from the magnet 22.

The control signal is an electric signal which is converted into the driving signal. When a current is flowed along the coil in the magnetic field, Lorentz's force is generated at the coil 23, and thus the operating part 13*a*, 13*b* in which the coil 23 is disposed is rotated.

The coil is disposed between one pair of magnets 22 so as to be spaced apart from the magnets 22 and wound with the sub-yoke 212 in the center.

And the magnet field generated from the magnet 22 passes through the coil 23 so as to be parallel with the driving shaft 12, and the pair of magnets 22 are disposed so that their polarities are opposite to each other.

Therefore, the coil 23 can be rotated along the sub-yoke around the driving shaft 12*a*, 12*b* between the magnets 22.

As described above, the driving part 20 consists of the first driving part 20*a* for providing driving force to the first operating part 13*a* and the second driving part 20*b* for providing driving force to the second operating part 13*b*.

As described above, the smart toy driving system for the mobile terminal of the present invention is connected to the mobile terminal such that the reaction generated by the interaction between the certain character and the mobile terminal user upon the execution of an application installed in the mobile terminal is expressed in a motion of the character, and thus it is possible to characterfully express the mobile terminal, double an interest in it and also provide more realistic game.

Next, a smart toy game system for the mobile terminal according to the present invention will be described.

The smart toy game system for the mobile terminal includes a memory part (not shown), a display part 2, an interface part (not shown) and a motion character 3.

The motion character 3 is the smart toy including the mechanism part 10, the driving part 20, the circuit part 30 and the terminal part 40.

An exclusive application for generating the audio signal is installed in the memory part.

That is, the exclusive application is the audio signal generating part 50 of the smart toy driving system.

Detailedly, the application is provided from the download server communicated with the user's mobile terminal 1 and then installed in the memory part.

The application may be previously installed in the mobile terminal 1, instead of being provided from the download server.

Therefore, the download server does not need to be an essential component of the smart toy game system.

The display part 2 receives a message which requires a user's response from the memory part when the application is executed and then displays it.

And the display part 2 displays a character image 4 interlocked with the motion character 3 which is detachably coupled to the mobile terminal.

The motion character 3 is a face of a man, an animal or the like and coupled to the mobile terminal 1.

As described above, the motion character 3 includes the mechanism part 10, i.e., the fixing part 11, and it is not limited to the character's face.

The character image 4 displayed on the display part 2 may be a body of the man or animal interlocked with the motion character 3 so as to express a motion corresponding to an action of the motion character 3.

Further, the display part 2 may display a character state such as health of the character and relationship with a user.

The character state may be the message requiring the user's response.

The interface part transmits user's response information for the message to the memory part.

The interface part may include one or more of a touch screen, a gyro sensor and a transmitting microphone.

In the touch screen, the display part 2 is touched by the user in order to transmit the user's response information to the application installed in the memory part.

The gyro sensor detects shaking of the mobile terminal 1 by the user and transmits response information to the memory.

Further, the transmitting microphone receives external noise, informationizes a loudness level and then transmits it to the memory part.

As described above, the interface part is used for proceeding the smart toy game when executing the application.

If the user's response information is input to the memory, the motion character 3 takes a predetermined specific action by the generated audio signal.

Hereinafter, the smart toy game system for the mobile terminal will be described fully.

First of all, the exclusive application is downloaded from the download server and installed in the memory part of the mobile terminal 1. Then, the terminal part 40 is inserted into the audio output terminal of the mobile terminal 1 so that the mechanism part 10 is coupled to the mobile terminal 1.

And if the application is executed, the character image 4 interlocked with the motion character 3 including the mechanism part 10 is displayed on the display part 2.

Herein, the motion character 3 is a cat's face, and eyelids of the cat's face are blinked and ears thereof are moved by the operation of the first and second operating parts 13*a* and 13*b*.

As shown in FIG. 10, when the audio signal is not generated from the application, the eyelids are opened and the ears are erected.

Meanwhile, the character image 4 output to the display part 2 is a cat's body of which a tail and paws are moved corresponding to the action of the motion character 3.

Further, the health of the character, relationship with a user or the like may be output on the display part 2 so as to allow the user to check the character state.

The motion character 3 and the character image 4 may be moved according to an health index of the character or a relationship index with the user, or a user's response signal.

And when the application is executed, the memory part outputs a message for requiring a user's response on the display part 2.

The user's response signal is transmitted to the memory part through the interface part according to the message output on the display part 2, and the audio signal is generated from the audio signal generating part 50.

The audio signal is transmitted to the circuit part 30 through the terminal part 40 connected to the audio output terminal of the mobile terminal 1.

In the circuit part 30, the audio signal is converted into the driving signal, and the first or second operating part 13*a* or 13*b* is operated by the driving signal.

Therefore, the eyes and ears of the character can be blinked and moved.

The message displayed on the display part 2 may be requirements for food, play, rest or the like and may be expressed in a speech bubble.

If a predetermined period of time is passed after the character eats the food, a message for requiring food to the user is output on the display part 2.

Further, various foods are displayed on the display part 2, a desired food that the character wants is selected and provided to the character by touching the touch screen.

The user may fill a bowl displayed on the display part 2 with the selected food or may put the food on other portions of the character image 4.

The character may take different actions according to the user's behavior.

The user's response information is input to the memory part in which the application is installed, and the character image 4 can express various actions according to the user's response information.

Moreover, if the user's response information is input to the memory, the application generates the audio signal having a specific pattern, and the audio signal is transmitted to the circuit part 30 through the terminal part 40, and thus the eyes and ears of the motion character 3 can be blinked and moved.

And if a predetermined period of time is passed after the user executes the application, a message for requiring play to the user is output on the display part 2.

The user can tickle or stroke the motion character 3 using the touch screen as if playing with a real animal, and can move the character image 4 according to the user's response signal through the interface part, and also can generate the audio signal so that the eyes and ears of the character are blinked and moved, thereby immediately confirming a reaction of the character.

Further, the application includes a sleep mode.

If a predetermined period of time is passed after the application is executed, the level of tiredness of the character is displayed on the display part 2.

Therefore, if the user shakes the mobile terminal 1, the shaking of the mobile terminal 1 is detected by the gyro sensor. If the shaking is detected for a predetermined period of time, the sleep mode of the character is begun.

Herein, the external sound is simultaneously input through the transmitting microphone, and if the level of the external sound input from the outside is larger than a predetermined value, a start time of the sleep mode is increased.

If a predetermined period of time is passed after the sleep mode is begun, the application is automatically ended.

A preset time for displaying the above-mentioned various messages may be changed according to an execution frequency of the application or the number of times that the interface part is used.

According to the smart toy driving system for the mobile terminal of the present invention, the character can be inserted into the terminal part of the mobile terminal which outputs the audio signal in order to prevent foreign substances from being introduced into the terminal part. Further, the character may take an action according to the operation of the mobile terminal, thereby providing fun to the user.

While the present invention has been described with respect to the specific embodiments, it will be apparent to those skilled in the art that various changes and modifications may be made without departing from the spirit and scope of the invention as defined in the following claims.

What is claimed is:

1. A smart toy driving system for a mobile terminal, comprising:

an audio signal generating part which is installed at the mobile terminal so as to generate an audio signal having a predetermined pattern;

a terminal part which is connected to an audio outputting terminal of the mobile terminal so that the audio signal is transferred thereto;

a signal converting part which receives the audio signal from the terminal part and then converts the received audio signal into a driving signal; and a driving part which receives the driving signal and operates a mechanism part so as to perform a certain action preset according to a waveform of the audio signal, wherein the mechanism part comprises: a fixing part which is coupled to the terminal part; and an operating part which is coupled to the fixing part so as to perform a predetermined action, and the driving part comprises: a yoke fixedly installed in the fixing part; a magnet fixed to the yoke and generating a magnetic field; and a coil installed at an end of the operating part, receiving the driving signal and generating a driving force caused by an electromagnetic interaction with the magnetic field generated from the magnet to thereby rotate the operating part, wherein the yoke includes a first yoke and a second yoke spaced apart from and facing the first yoke, and a third yoke disposed between the first yoke and the second yoke;

wherein the magnet includes a first magnet fixed to an inner side of the first yoke and a second magnet fixed to an inner side of the second yoke; and wherein the coil is disposed between the first magnet and the second magnet and wound around the third yoke.

2. The smart toy driving system according to claim 1, wherein the audio signal generating part includes an application program installed at a memory of the mobile terminal.

3. The smart toy driving system according to claim 1, wherein the audio signal includes a stereo signal having first and second audio signals.

4. The smart toy driving system according to claim 2, wherein the audio signal includes a stereo signal having first and second audio signals.

5. The smart toy driving system according to claim 1, wherein the operating part includes: a first operating part which is coupled to the fixing part so as to perform a predetermined action; and a second operating part which is coupled to the fixing part and operated independently from the first operating part so as to perform a predetermined action; and wherein the audio signal is a two-channel stereo signal having first and second audio signals, the first operating part is operated by the first audio signal, and the second operating part is operated by the second audio signal.

* * * * *